US005650385A

United States Patent [19]

Dunn et al.

[11] Patent Number: 5,650,385

[45] Date of Patent: *Jul. 22, 1997

[54] AQUEOUS METAL CLEANER

[75] Inventors: Steven Dunn, Hillsborough; Anthony Winston, East Brunswick, both of N.J.

[73] Assignee: Church & Dwight Co., Inc., Princeton, N.J.

[*] Notice: The term of this patent shall not extend beyond the expiration date of Pat. No. 5,614,027.

[21] Appl. No.: 609,895

[22] Filed: Mar. 4, 1996

Related U.S. Application Data

[63] Continuation of Ser. No. 311,254, Sep. 23, 1994, abandoned.

[51] Int. Cl.[6] ..... C11D 1/66; C11D 1/825

[52] U.S. Cl. ..... 510/245; 510/254; 510/421; 510/422; 510/423; 510/433; 510/475; 510/500; 510/509; 510/492

[58] Field of Search ..... 510/245, 254, 510/421, 422, 423, 433, 475, 500, 509, 492

[56] References Cited

U.S. PATENT DOCUMENTS

| | | | |
|---|---|---|---|
| 4,106,901 | 8/1978 | Bishop et al. | 252/158 |
| 4,135,878 | 1/1979 | Bishop et al. | 8/139 |
| 4,450,102 | 5/1984 | Lindstrom et al. | 252/542 |
| 4,575,569 | 3/1986 | Edwards | 568/45 |
| 4,793,942 | 12/1988 | Lokkesmoe et al. | 252/99 |
| 4,820,436 | 4/1989 | Andree et al. | 252/544 |
| 4,931,205 | 6/1990 | Edwards et al. | 252/174.21 |
| 5,093,031 | 3/1992 | Login et al. | 252/357 |
| 5,230,824 | 7/1993 | Carlson, Sr. et al. | 252/174.21 |
| 5,275,755 | 1/1994 | Sebag et al. | 252/174.15 |
| 5,336,445 | 8/1994 | Michael et al. | 252/548 |
| 5,362,422 | 11/1994 | Masters | 252/544 |

*Primary Examiner*—Michael Tierney
*Attorney, Agent, or Firm*—Irving M. Fishman

[57] ABSTRACT

A metal cleaning composition useful in aqueous solution comprises an alkalinity providing agent and a combination of surfactants comprising an ethoxylated thiol surfactant and a nitrogen-containing surfactant which reduces the odor of the thiol-containing surfactant. The aqueous cleaning solutions of this invention are particularly useful in metal parts washers typically placed in garages, service stations and the like in which the cleaning solution can be filtered and reused in the parts washer.

41 Claims, 1 Drawing Sheet

AQUEOUS METAL CLEANER

This application is a continuation, of application Ser. No. 08/311,254, filed Sep. 23, 1994 now abandoned.

BACKGROUND OF THE INVENTION

The present invention relates generally to aqueous metal cleaning compositions. In particular, this invention is directed to aqueous metal cleaning compositions useful in so-called parts washers and, in particular, to parts cleaners, which are particularly adapted to be used by professional or semi-professional mechanics, as well as homeowners, farmers, ranchers, hobbyists, or other such users.

Parts washers of various kinds are known to those skilled in the art as having great utility for mechanics and others working in a variety of occupations, particularly those working in industrial plants, maintenance and repair services, and the like. At one time, the development of parts washers was based on an attempt to insure reasonable convenience in use and good cleaning action. Many garages, service stations and the like owned and used soak tanks, so-called hot tanks, or immersion type parts cleaners, usually of more or less elaborate configuration.

U.S. Pat. No. 3,522,814 to Olson and assigned to Safety-Kleen Corp. described a new concept in parts washers insofar as it related to a parts washer construction which included among other novel features, a construction particularly adapted to facilitate extremely rapid and simple machine service. An entire industry was then founded on the concept of a parts washer which was designed so that it could be economically and effectively serviced by route men with little, if any, specialized training. It was discovered that there was an enormous market among garage and service station owners, automobile dealers, and industrial plant operators for a parts washer which could be serviced safely and without disrupting operations, either by way of down-time or physically interfering with such operations.

The ideal parts washer is reliable, safe, quiet and effective in use, is free from environmental objections, and perhaps most importantly, can be serviced readily as just discussed. While the parts washer described in U.S. Pat. No. 3,522,814 has achieved phenomenal success in commercial markets, various improvements have been made and are disclosed in several U.S. patent including; U.S. Pat. No. 4,096,873; U.S. Pat. No. 4,160,603; U.S. Pat. No. 4,261,378; U.S. Pat. No. 4,462,415 and U.S. Pat No. 4,637,413.

The device described in the foregoing patent to Olson has been extremely successful in the industry by providing a parts washer having economic and hazard-free operation to subject parts to be cleaned to a circulating flow of solvent and the like. In operation of the device described in the Olson patent, a pump circulates a solvent from a drum into a sink containing parts for cleaning. A flow of solvent is directed against the parts and drains from the sink through a filtering medium for return to the drum. In the event of a fire, the washer described in U.S. Pat. No. 3,522,814 is capable of automatically closing a cover over the sink to minimize its effect.

Although the washer of U.S. Pat. No. 3,522,814 provides highly improved operative characteristics during cleaning, it has been found that it becomes advantageous to subject parts for a period of time to a soaking bath in a solvent or other fluid under certain encountered conditions such as, for example, where an extraordinary amount of foreign material is affixed to the elements to be washed. In known techniques, such soaking is accomplished generally by positioning the parts in a volume of fluid in an opened container from which undesired solvent fumes may be evaporated to the surroundings with a resulting costly depletion of fluid and the danger of uncontrolled fire or spilling being present. The prevention of such uncontrolled soaking in an open vessel has become more advantageous in the light of numerous government regulations governing the use of substances in the form of solvents such as required by O.S.H.A. and the like. Thus, U.S. Pat. No. 4,261,378 mentioned above, provides a highly advantageous accessory which allows effective washing of parts with drainage such as disclosed in U.S. Pat. No. 3,522,814, with the alternative mode of operation as a highly effective and non-hazardous soaking device.

The accessory disclosed in U.S. Pat. No. 4,261,378 overcomes the foregoing problems by permitting a conventional washer to operate in its normal circulating mode without a substantial soaking action, with the added improvement of selectively retaining a quantity of solvent in a sink for a soaking application. The soaking operation provided by the accessory is accomplished by a device which prevents the escape of fumes to the surroundings and the costly evaporation of the cleaning solvent, and which at the same time minimizes the danger of fire and other accidents. In addition, the accessory provides improved soaking by maintaining a predetermined level of fluid over the parts to be cleaned with constant circulation of the solvent. U.S. Pat. No. 4,261,378 is herein incorporated by reference.

Existing solvents, with or without special additives, are adequate to achieve good cleaning of most dirty, greasy, mechanical parts. A great number of these solvents are employed to produce metallic surfaces free from contamination. These wash solvent compositions generally employ various halogenated hydrocarbons and non-halogenated hydrocarbons, of significant quantity industry wide for cleaning and degreasing of the metal surfaces, and the degree of success with each of these wash solvent compositions is generally dependent upon the degree of cleanliness required of the resultant surface.

Recently, however, the various hydrocarbon and halogenated hydrocarbon metal cleaning compositions previously employed have come under scrutiny in view of the materials employed, and in particular, the environmental impact from the usage of the various materials. This is particularly so in the case of parts cleaning which is done in closed environments such as garages and the like or for even home usage in view of the close human contact. Even the addition of devices to parts washers which can reduce spillage, fire and excessive volatilization of the cleaning solvent are not sufficient to alleviate present environmental concerns.

Although the halogenated hydrocarbon solvents such as chlorofluorocarbons (CFCs) and trichloromethane, methylene chloride and trichloroethane (methyl chloroform) are widely used in industry for metal cleaning, their safety, environmental and cost factors coupled with waste disposal problems are negative aspects in their usage. A world-wide and U.S. ban on most halogenated hydrocarbon solvents is soon in the offing by virtue of the Montreal Protocol, Clean Air Act and Executive and Departmental directives.

The non-halogenated hydrocarbon solvents such as toluene and Stoddard solvent and like organic compounds such as ketones and alcohols on the other hand are generally flammable, have high volatility and dubious ability to be recycled for continuous use. These, plus unfavorable safety, environmental and cost factors, put this group of solvents in a category which is unattractive for practical consideration. Most useful organic solvents are classified as volatile organic compounds (VOCs) which pollute the atmosphere, promote formation of toxic ozone at ground level, and add to the inventory of greenhouse gases.

In order to eliminate the various negative aspects of the known chemical washing and degreasing systems, it has, therefore, been suggested that an aqueous detergent system be used so as to overcome some of the inherent negative environmental and health aspects of prior art solvent cleaning systems. Unfortunately, aqueous cleaning systems are not without their own problems as related to used thereof in metal cleaning systems including use in the parts washers described above. For example, certain of the aqueous cleaners are exceedingly alkaline having pHs of 13 and above such as sodium hydroxide or include organic solvents such as alkanolamine, ethers, alcohols or glycols and the like. Besides being highly corrosive, the exceedingly high alkaline aqueous solutions are highly toxic and can be dangerous to handle requiring extreme safety measures to avoid contact with skin. Organic solvent-containing aqueous cleaners present the problems regarding toxicity or the environment as expressed previously. On the other hand, it is most difficult to obtain an aqueous detersive solution at moderate pH which is effective in removing the greases and oils which contaminate metal including metal engine parts and which would not be corrosive to the metal substrate.

U.S. Pat. No. 5,230,824 discloses an aqueous metal cleaning composition for removing oil, dirt and grinding debris from razor blades and which comprises an alkalinity providing agent, a chelating agent, a hydrotrope and a defoaming agent together with a non-ionic surfactant. The preferred alkalinity providing agents include the alkali metal hydroxides, the alkali metal silicates and the alkali metal carbonates. The non-ionic surfactant comprises the ethoxylates of $C_9$–$C_{16}$ tertiary thiols as described in U.S. Pat. Nos. 4,575,569 and 4,931,205.

While the ethoxylated thiol surfactants have been found to be highly effective in aqueous solution for the removal of grease from substrates, particularly metal surfaces, one drawback of these surfactants is the very unpleasant odor which the surfactant imparts to the product such as an aqueous concentrate to which the surfactants are added as well as to the more dilute wash solutions which contain these ethoxylated thiol surfactants. The unpleasant odor significantly reduces the types of product to which the ethoxylated thiols can be added. This would be particularly so of the parts washing systems such as described above and developed by Safety-Kleen Corp. which have been very successful in the commercial service area including garage and service stations, automobile dealers and the like. In the typical enclosed environments which such commercial enterprises operate, the unpleasant odor of the ethoxylated thiol surfactants would not be tolerated and the use thereof would greatly hinder the commercial operation. On the other hand, the excellent grease removing ability of these surfactants render them most useful in aqueous cleaning systems for parts washing devices and methods of metal cleaning.

Accordingly, it is an object of the present invention to provide an aqueous metal cleaning composition which is effective to clean grease, oil and other contaminants from a metal surface without being excessively corrosive to the substrate and irritating to human skin.

Another object of the invention is to provide an aqueous metal cleaning composition which can be used effectively in immersion and impingement type parts washers so as to efficiently remove grease, oil and other contaminants from metal parts and which are safe to use and not a hazard to the environment in use or upon disposal.

Still another object of the present invention is to provide an aqueous metal cleaning composition which contains an ethoxylated thiol surfactant and which is formulated so as to greatly reduce if not eliminate the unpleasant odor associated with the surfactant.

Yet another object of the present invention is to provide an aqueous cleaning composition containing an ethoxylated thiol surfactant and which does not have the unpleasant odor associated with the surfactant and, thus, can be effectively used in immersion and impingement type parts washers and in the relatively closed commercial settings in which such parts washers are utilized.

SUMMARY OF THE INVENTION

The above-mentioned objectives and other objects are obtained in accordance with the present invention by providing an aqueous alkaline metal cleaning solution which has a pH of less than 12 but a sufficiently high pH to effectively clean dirt, grease, oil and the like from metal and which includes an ethoxylated thiol surfactant which greatly enhances the detersive ability of the aqueous alkaline solution but does not impart an unpleasant odor thereto. Unlike the halogenated or hydrocarbon solvents of the prior art, the aqueous alkaline solution of this invention is environmentally safe in use having only low amounts of organics which do not readily volatilize and which is safe on disposal thereof.

The aqueous metal cleaning composition of the present invention comprises an alkalinity providing agent and a combination of surfactants comprising an ethoxylated thiol and a nitrogen-containing surfactant which greatly reduces if not eliminates the unpleasant odor associated with the ethoxylated thiol surfactant. The nitrogen-containing surfactant does not reduce the efficacy of the ethoxylated thiol relative to the ability to cut grease from the metal substrate. Moreover, the cleaning composition of this invention does not readily emulsify the oil and grease which is removed from the metal surface so as to allow such grease and oil to be skimmed or otherwise easily separated from the wash bath for disposal. Consequently, the cleaning ability of the aqueous cleaner can be maintained for prolonged reuse.

The aqueous cleaning composition of this invention is particularly effective when used in the parts washing systems such as those developed by Safety-Kleen Corporation and the like which have become enormously successful commercially, whether controlled manually or of automatic type. The cleaning composition and aqueous cleaning solutions formed therefrom are especially useful in washing systems situated in relatively closed commercial quarters such as gas stations, garages and the like. The aqueous metal cleaning compositions of this invention for use in such parts washing systems are particularly advantageous since such compositions are environmentally and physically safe to use in relatively closed environments and can be handled, stored and disposed of without the environmental problems caused by volatile and toxic organics or the hazards of extremely high alkaline aqueous compositions which have been previously suggested.

BRIEF DESCRIPTION OF THE DRAWING

The Figure is a graph of cleaning efficacy comparing the inventive formulation with known commercial cleaners.

DETAILED DESCRIPTION OF THE INVENTION

Figure 1:
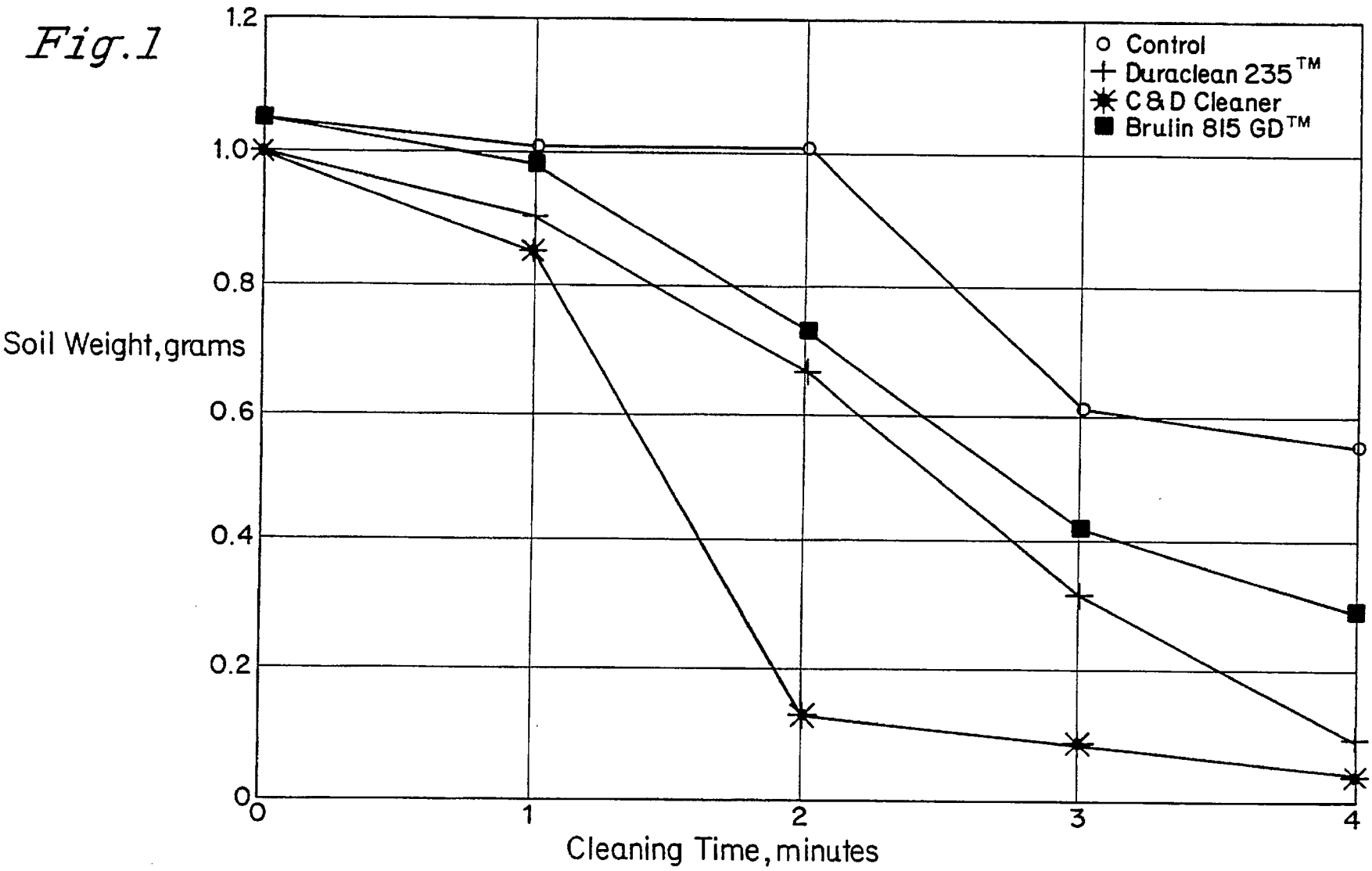

The aqueous cleaning compositions of the present invention comprise an alkalinity providing agent and a combination of two surfactants, one being an ethoxylated thiol which is very effective in removing grease and oil from metal substrates and a nitrogen-containing surfactant which surprisingly greatly reduces the odor associated with the ethoxylated thiol surfactant and does not reduce the efficacy of the ethoxylated thiol surfactant. The aqueous alkaline metal cleaning solutions have a pH of at least 8.0 to less than 12, preferably less than 11.0 so as to render these solutions substantially less harmful to use and handle than highly alkaline aqueous cleaners such as those formed from sodium hydroxide or aqueous alkanol amine solutions. Most preferably, the aqueous alkaline cleaning solutions have a pH from about 8.0 to 10.0 which is effective to remove the dirt, grease, oil and other contaminants from the metal surface and yet allow the solutions to be used, handled and disposed of without burning or irritating human skin. Also, it is preferable that the composition of this invention be free of organic solvents, including hydrocarbon, halohydrocarbon and oxygenated hydrocarbon solvents.

The alkalinity providing agent of the aqueous metal cleaning compositions of the present invention can be provided by one or more alkaline salts. Suitable alkaline salts or mixtures thereof useful in the present invention are those capable of providing the desired pH. Most suitable are the salts of potassium and sodium. Especially preferred are the potassium and sodium carbonates and bicarbonates which are economical, safe and environmentally friendly. The carbonate salts include potassium carbonate, potassium carbonate dihydrate, potassium carbonate trihydrate, sodium carbonate, sodium carbonate decahydrate, sodium carbonate heptahydrate, sodium carbonate monohydrate, sodium sesquicarbonate and the double salts and mixtures thereof. The bicarbonate salts include potassium bicarbonate and sodium bicarbonate and mixtures thereof. Mixtures of the carbonate and bicarbonate salts are also especially useful.

Although not preferred, other suitable alkaline salts which can be used include the alkali metal ortho or complex phosphates. The complex phosphates are especially effective because of their ability to chelate water hardness and heavy metal ions. The complex phosphates include, for example, sodium or potassium pyrophosphate, tripolyphosphate and hexametaphosphates. Additional suitable alkaline salts useful in the metal cleaning compositions of this invention include the alkali metal borates, acetates, citrates, tartrates, succinates, silicates, phosphonates, edates, etc.

The alkoxylated (ethoxylated) thiol surfactants of the present invention are known nonionic surfactants and are described for example in U.S. Pat. Nos. 4, 575,569 and 4,931,205, the contents of both of which are herein incorporated by reference. In particular, the ethoxylated thiol is prepared by the addition of ethylene oxide to an alkyl thiol of the formula R—SH wherein R is alkyl in the presence of either an acid or base catalyst.

The thiol reactant that is suitable for producing the surfactant used in the practice of the present invention comprises, in the broad sense, one or more of the alkane thiols as have heretofore been recognized as suitable for alkoxylation by reaction with alkylene oxides in the presence of basic catalysts. Alkane thiols in the 6 to 30 carbon number range are particularly preferred reactants for the preparation of thiol alkoxylates for use as surface active agents, while those in the 7 to 20 carbon number range are considered more preferred and those in the 8 to 18 carbon number range most preferred.

The thiol reactant molecule is suitably either primary, secondary, or tertiary and of either linear, branched, or cyclic carbon structure. Specific examples of suitable tertiary thiols are those having a highly branched carbon chain which are derived via hydrosulfurization of the products of the oligomerization of lower olefins, particularly those dimers, trimers, and tetrameres and pentamers of propylene and the butylenes. Secondary thiols are exemplified by the lower alkane thiols, such as 2-propanethiol, 2-butanethiol, and 3-pentanethiol, as well as by the products of the hydrosulfurization of the substantially linear oligomers of ethylene as are produced by the Oxo process. Representative, but by no means limiting, examples of thiols derived from ethylene oligomers include the linear carbon chain products, such as 2-decanethiol, 3-decanethiol, 4-decanethiol, 5-decanethiol, 3-dodecanethiol, 5-dodecanethiol, 2-hexadecanethiol, 5-hexadecanethiol, and 8-octadecanethiol, and the branched carbon chain products, such as 2-methyl-4-tridecanethiol. Primary thiols are typically prepared from terminal olefins by hydrosulfurization under free-radical conditions and include, for example, 1-butanethiol, 1-hexanethiol, 1-dodecanethiol, and 1-tetradecanethiol and 2-methyl-1-tridecanethiol. Polythiol reactants, having multiple —SH groups, can be used although monothiolic reactants are preferred. Particular preference exists for a reactant consisting essentially of one or more secondary and tertiary thiols.

Broadly, the surfactant can be formed from reaction of the above alkyl thiol and one or more of the several alkylene oxides known for use in alkoxylation reactions with thiols and other compounds having active hydrogen atoms. Particularly preferred are the vicinal alkylene oxides having from 2 to 4 carbon atoms, including ethylene oxide, 1,2-propylene oxide, and the 1,2-and 2,3-butylene oxides. Mixtures of alkylene oxides are suitable in which case the product will be mixed thiol alkoxylate. Thiol alkoxylates prepared from ethylene or propylene oxides are recognized to have very advantageous surface active properties and for this reason there is a particular preference for a reactant consisting essentially of ethylene oxide which is considered most preferred for use in the invention.

The relative quantity of thiol and alkylene oxide reactants determine the average alkylene oxide number of the alkoxylate product. In the alkoxylated thiol surfactant of this invention an adduct number in the range from about 3 to 20, particularly from about 3 to 15 is preferred. Accordingly, preference can be expressed in the practice of the invention for a molar ratio of alkylene oxide reactant to thiol reactant which is in the range from about 3 to 20, particularly from about 3 to 15. Especially preferred is an ethoxylated dodecyl mercaptan with about 6 ethylene oxide units. Such a surfactant is a commercial product known as ALCODET 260 marketed by Rhone-Poulenc.

Unfortunately, the ethoxylated thiol surfactant useful in the aqueous cleaning compositions of this invention has an unpleasant odor which is imparted to the aqueous solution in which it is placed. It has now been found that the addition of a nitrogen-containing surfactant eliminates the odor of the sulfur-containing surfactant and does not adversely effect the efficacy of the ethoxylated thiol surfactant to remove grease, oil and the like from the metal surfaces. Among useful nitrogen-containing nonionic surfactants are the following:

A surfactant having a formula $R^1R^2R^3N\rightarrow O$ (amine oxide detergent) wherein $R^1$ is an alkyl group containing from about 10 to about 28 carbon atoms, from zero to about two hydroxy groups and from zero to about five ether linkages, there being at least one moiety of $R^1$ which is an alkyl group containing from about 10 to about 18 carbon atoms and zero ether linkages, and each $R^2$ and $R^3$ are selected from the group consisting of alkyl radicals and hydroxyalkyl radicals containing from one to about three carbon atoms.

Specific examples of amine oxide surfactants include: Dimethyldodecylamine oxide, dimethyltetradecylamine oxide; ethylmethyltetradecylamine oxide, cetyldimethylamine oxide, dimethylstearylamine oxide, cetylethylpropylamine oxide, diethyldodecylamine oxide, diethyltetradecylamine oxide, dipropyldodecylamine oxide, bis-(2-hydroxyethyl)dodecylamine oxide, bis-(2-hydroxyethyl)-3-dodecoxy-1-hydroxypropyl amine oxide, (2-hydroxypropyl) methyltetradecylamine oxide, dimethyloleyamine oxide, dimethyl-(2-hydroxydodecyl)amine oxide, and the corresponding decyl, hexadecyl and octadecyl homologs of the above compounds.

Additional nitrogen-containing surfactants include ethoxylated primary alkyl amines where the alkyl group has 10–20 carbon atoms and the amine is ethoxylated with 2–20 ethylene oxide units. Further surfactants include ethoxylated long chain fatty acid amides where the fatty acid has 8–20 carbon atoms and the amide group is ethoxylated with 1–20 ethylene oxide units. Additionally, nonionic surfactants derived from the condensation of ethylene oxide with the product resulting from the reaction of propylene oxide and ethylene diamine are also useful. For example, compounds containing from about 40% to about 80% of polyoxyethylene by weight and having a molecular weight from about 5,000 to about 11,000 resulting from the reaction of ethylene oxide groups with a hydrophobic base constituted of the reaction product from ethylene diamine and excess propylene oxide wherein the base has a molecular weight on order of 2,500–3,000 are satisfactory.

One of the most useful nitrogen-containing surfactants which can be used in combination with the ethoxylated thiol surfactant are those derived from N-alkyl pyrrolidone. Particularly preferred are N-(n-alkyl)-2-pyrrolidone wherein the alkyl group contains 6–15 carbon atoms. These compounds are described in U.S. Pat. No. 5,093,031, assigned to ISP Investments, Inc., Wilmington, Del. and which discloses surface active lactams and is herein incorporated by reference. The above N-alkyl pyrrolidone products having a molecular weight of from about 180 to about 450 are conveniently prepared by several known processes including the reaction between a lactone having the formula

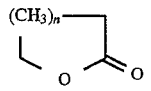

wherein n is an integer from 1 to 3, and an amine having the formula R'—$NH_2$ wherein R' is a linear alkyl group having 6 to 20 carbon atoms. The amine reactant having the formula R'—$NH_2$ includes alkylamines having from 6 to 20 carbon atoms; amines derived from natural products, such as coconut amines or tallow amines distilled cuts or hydrogenated derivatives of such fatty amines. Also, mixtures of amine reactants can be used in the process for preparing the pyrrolidone compounds. Such mixtures can include linear amino species having an alkyl of the same or different molecular weight. To form the pyrrolidone, the amine and lactone reactants, combined in a mole ration of from about 1:1 to about 1:5, are reacted under conditions of constant agitation, at a temperature between about 100° C. and about 350° C. under a pressure of from atmospheric to about 650 psig for a period of from about 1 to about 15 hours; preferably at 250° C. to 300° C. under an initial ambient pressure for a period of from 5 to 10 hours. The resulting pyrrolidone product is recovered and purified by distillation or by any other convenient recovery process.

The N-alkyl pyrrolidone products having 11 to 14 carbon atoms are clear, water white liquids, at room temperature; whereas those having 16 or more carbon atoms are solids. These pyrrolidones have a neutral or slightly basic pH, a surface tension between about 25 and about 35 dynes/cm as a 0.1% water solution and a viscosity of from about 6 to about 30 cps at 25° C.

Generally, the $C_6$ to $C_{14}$ alkyl pyrrolidones display primarily surfactant properties; whereas the $C_{16}$ to $C_{22}$ alkyl species are primarily complexing agents; although some degree of surfactant and complexing capability exists in all of the present species. One particular advantage of the alkyl pyrrolidone surfactants is the additional detergency that these surfactants provide to the compositions of this invention.

U.S. Pat. No. 5,093,031 states that the inventive compounds control objectionable odors emanating from metal treating and slaughter house operations as well as household odors on rugs, furniture, clothing or encountered in pet environments. The surfactants of the patent are stated as being able to complex with odor forming bodies in animal and human waste containing, for example, mercaptan, urea, tars, nicotine, molds and other odor causing chemicals.

The relative amounts of the ethoxylated thiol surfactant and nitrogen-containing surfactant are not overly critical as far as a contrite range is concerned in that the amount of the nitrogen surfactant will vary depending on the surfactant used. The amount of nitrogen-containing surfactant used should be that which can reduce if not eliminate the odor of the ethoxylated thiol surfactant. In general, it is believed that the relative amounts by weight of the ethoxylated thiol surfactant to the nitrogen-containing surfactant should range from about 1.0:0.1 to 1.0:2.0, and preferably from about 1.0:0.2 to 1:1. It is not meant that these ratios be considered as strictly limiting the invention and as providing the only relative amounts of the respective surfactants which can be effectively used and accordingly, it is intended that any useful ratio be considered part of the present invention. Any useful ratio is that ratio which is sufficient to remove the dirt, grease, oil and other contaminants from the metal surface and which will yield an aqueous product which has greatly reduced malodor relative to an equivalent composition in which the ethoxylated thiol surfactant is present and the nitrogen-containing surfactant is not.

Besides the alkalinity providing agent and the surfactant combination as described above, the aqueous metal cleaning compositions of the present invention preferably include a hydrotrope and a polycarboxylate which prevents precipitation of water hardness salts. In use, the dry ingredients of the invention are provided in solution in water which is preferably deionized or purified by reverse osmosis treatment and the like.

The polymeric antiprecipitating agents may be generically categorized as a water-soluble carboxylic acid polymer or a vinyl addition polymer. Polyacrylates are especially preferred. Of the vinyl addition polymers contemplated, maleic anhydride copolymers as with vinyl acetate, styrene, ethylene, isobutylene, acrylic acid and vinyl ethers are preferred.

All of the above-described polymers are water-soluble or at least colloidally dispersible in water. The molecular weight of these polymers may vary over a broad range although it is preferred to use polymers having average molecular weights ranging between 1,000 up to 1,000,000. In a preferred embodiment of the invention, these polymers have a molecular weight of 100,000 or less and, most preferably, between 1,000 to 10,000. While higher molecular weight polymers may be used, there is no particular advantage in their utilization because they tend to be broken down due to the shear forces found in recirculating cooling systems. Also, when used in larger amounts in concentrated formulas, they produce highly viscous products that are difficult to use.

The water-soluble polymers of the type described above are often in the form of copolymers which are contemplated as being useful in the practice of this invention provided they contain at least 10% by weight of $$-\overset{\overset{\displaystyle O}{\|}}{C}-OM$$

groups where M is hydrogen, alkali metal, ammonium or other water-solubilizing radicals. The polymers or copolymers may be prepared by either addition or hydrolytic techniques. Thus, maleic anhydrided copolymers are prepared by the addition polymerization of maleic anhydride and another comonomer such as styrene. The low molecular weight acrylic acid polymers may be prepared by addition polymerization of acrylic acid or its salts either with itself or other vinyl comonomers. Alternatively, such polymers may be prepared by the alkaline hydrolysis of low molecular weight acrylonitrile homopolymers or copolymers. For such a preparative technique see Newman U.S. Pat. No. 3,419,502.

As previously stated, maleic anhydride polymers are preferred. Especially useful maleic anhydride polymers are selected from the group consisting of homopolymers of maleic anhydride, and copolymers of maleic anhydride with vinyl acetate, styrene, ethylene, isobutylene, acrylic acid and vinyl ethers. These polymers can be easily prepared according to standard methods of polymerization.

The carboxylated polymer prevents scaling due to precipitation of water hardness salts formed during reaction with the alkaline salts of the cleaning compositions of this invention.

The hydrotropes useful in this invention include the sodium, potassium, ammonium and alkanol ammonium salts of xylene, toluene, ethylbenzoate, isopropylbenzene, naphthalene, alkyl naphthalene sulfonates, phosphate esters of alkoxylated alkyl phenols, phosphate esters of alkoxylated alcohols and sodium, potassium and ammonium salts of the alkyl sarcosinates. The hydrotropes are useful in maintaining the surfactant readily dispersed in the aqueous cleaning solution and, in particular, in an aqueous concentrate which is an especially preferred form of packaging the compositions of the invention and allow the user of the compositions to accurately provide the desired amount of cleaning composition into the aqueous wash solution. A particularly preferred hydrotrope is one that does not foam. Among the most useful of such hydrotropes are those which comprise the alkali metal salts of intermediate chain length monocarboxylic fatty acids, i.e., $C_7$–$C_{13}$. Particularly preferred are the alkali metal octanoates and nonanoates.

The metal cleaning compositions of this invention comprise from about 20 to 80 weight percent based on the dry components of the alkalinity providing agent, 4 to 50 weight percent of the ethoxylated thiol surfactant, 1–30 weight percent of the nitrogen-containing surfactant, 0–10 weight percent of the anti-scaling agent and 0–30 weight percent of the hydrotrope. If the alkalinity providing agent is the preferred carbonate and bicarbonate salts, the combination of such salts should be present in the amounts of 20–80 percent by weight. Preferably, if such a mixture is utilized the amount of bicarbonate salts should comprise from about 5–80 weight percent and the carbonate salts from about 5–60 percent by weight based on the dry composition. The dry composition is used in the aqueous wash solution in amounts of about 0.1–20 weight percent, preferably from about 0.2–5 weight percent. Most preferably, the metal cleaning compositions of the present invention are provided and added to the wash bath as an aqueous concentrate in which the dry components of the composition comprise from about 5–45 weight percent of the concentrate and, preferably, from about 5–20 weight percent.

The aqueous metal cleaning solutions of the present invention are useful in removing a variety of contaminants from metal substrates. In particular, metal substrates comprising engine parts which are contaminated with grease and oil are advantageously cleaned using the metal cleaning compositions of this invention and aqueous solutions of such compositions. A useful method of cleaning such metal parts is in a parts washer. In such parts washers the metal parts are contacted with the aqueous solution either by immersion or some type of impingement in which the aqueous cleaning solution is circulated continuously on the metal part or is sprayed thereon. Alternatively, agitation can be provided as ultrasonic waves. The cleaning solution is then filtered and recycled for reuse in the parts washer. For best use, the aqueous cleaning solutions of this invention should be at an elevated temperature typically ranging from about 90°–180° F. The contact time of the aqueous cleaning solution with the metal substrates including metal engine parts will vary depending upon the degree of contamination but broadly will range between about 1 minute to 30 minutes with 3 minutes to 15 minutes being more typical.

The metal cleaning compositions of the present invention are useful for removing any type of contaminant from a metal surface including greases, cutting fluids, drawing fluids, machine oils, antirust oils such as cosmoline, carbonaceous soils, sebaceous soils, particulate matter, waxes, paraffins, used motor oil, fuels, etc. Any metal surface can be cleaned including iron-based metals such as iron, iron alloys, e.g., steel, tin, aluminum, copper, tungsten, titanium, molybdenum, etc., for example. The structure of the metal surface to be cleaned can vary widely and is unlimited. Thus, the metal surface can be as a metal part of complex configuration, sheeting, coils, rolls, bars, rods, plates, disks, etc. Such metal components can be derived from any source including for home use, for industrial use such as from the aerospace industry, automotive industry, electronics industry, etc., wherein the metal surfaces have to be cleaned.

EXAMPLE 1

The following panel test was run to determine whether or not nitrogen-containing compounds would reduce the odor of a cleaning formulation containing an ethoxylated thiol surfactant. Table 1 sets forth the formulation and control (without nitrogen-containing compounds).

TABLE 1

| | Samples | | | |
|---|---|---|---|---|
| | A | | B | |
| Ingredients | wt % | wt(g) | wt. % | wt(g) |
| 1 DI H2O | 78.2 | 312.80 | 79.7 | 318.80 |
| 2 Sodium bicarbonate | 7.36 | 29.44 | 7.36 | 29.44 |
| 3 Pot. carbonate | 1.96 | 7.84 | 1.96 | 7.84 |

TABLE 1-continued

| Ingredients | Samples A wt % | A wt(g) | B wt. % | B wt(g) |
|---|---|---|---|---|
| 4 Sod. carbonate | 1.60 | 6.40 | 1.60 | 6.4 |
| 5 Alcosperse 408[1] | 0.38 | 1.52 | 0.38 | 1.52 |
| 6 Monatrope 1250[2] | 6.00 | 24.00 | 6.00 | 24.00 |
| 7 Alcodet 260[3] | 3.00 | 12.00 | 3.00 | 12.00 |
| 8 ISP LP-100[4] | 1.50 | 6.00 | — | — |
| TOTALS | 100.00 pH 9.00 | 400.00 | 100.00 pH 9.00 | 400.00 |

[1]acrylic acid polymer, Alco Chemical Co., Chatanooga, TN
[2]sodium nonanoate, Mona Industries
[3]ethoxylated dodecyl mercaptan (6 ethylene oxide units)
[4]N-alkyl pyrrolidone, ISP The odor panel protocol was as follows. Both solutions were evaluated at room temperature for comparable objectionable odors. A panel of 6 persons were requested to smell comparative formulation Sample B and give it a 7 on a scale of 1–10. Subsequently, each member of the panel was requested to smell formulation Sample A and rate the odor of the solution on a scale of 1–10. Table 2 sets forth the results.

TABLE 2

| Panel member | 1 | 2 | 3 | 4 | 5 | 6 |
|---|---|---|---|---|---|---|
| Scale Value (B-A) | 7-3 | 7-3.5 | 7-5 | 7-3 | 7-2 | 7-5 |

All six panel members picked the formulation of the present invention (Sample A) as having less malodor than Comparative Sample B.

A second test was conducted in which Samples A and B were diluted (10X) with water and evaluated at 160° F. In this odor panel test, the comparative formulation Sample B was smelled and was given a 5 on the scale of 1–10. The formulation Sample A was then smelled and provided with a rating by each panel member. Table 3 sets for the results of the panel test.

TABLE 3

| Panel member | 1 | 2 | 3 | 4 | 5 |
|---|---|---|---|---|---|
| (Scale Value) | 5-1 | 5-1 | 5-2 | 5-2.5 | 5-2 |

Again, all five of the panel members picked formulation Sample A as having less malodor than Comparative Sample B.

EXAMPLE 2

In this example, further odor testing was done to determine whether various nitrogen-containing compounds including the pyrrolidone compound used in Example 1 and other nitrogen and non-nitrogen containing compounds could reduce the malodor of a cleaning composition containing the ethoxylated thiol surfactant. Significant reduction of malodor was determined by using a sequential analysis chart. Control Sample C had the formulation as set forth in Table 4 below.

TABLE 4

SAMPLE C

| Ingredients | Wt. % |
|---|---|
| DI $H_2O$ | 81.08 |
| Sodium bicarbonate | 4.48 |
| Potassium carbonate | 2.90 |
| Sodium carbonate | 2.22 |
| Magnesium oxide | 0.074 |
| Carboxylate copolymer[1] | 0.25 |
| Monotrope 1250 | 6.00 |
| Alcadet 260 | 3.00 |

[1]Acrylic acid/maleic acid copolymer, molecular weight 4,500.

Samples D–I had the same formulation as the control example except that 1.50% of the water was replaced with the respective compound being tested for malodor reduction. Table 5 summarizes the testing of the six compounds D–I with respect to malodor reduction of the control.

TABLE 5

| Sample | Deodorizing compound | No. Panelists Preferring Test | Control | Sig. Diff.[1] (95%) | Av. Odor Test | Control |
|---|---|---|---|---|---|---|
| D | LP-100 | 28 | 2 | yes | 3 | 5 |
| E | $C_{18}$ amide[2] | 14 | 2 | yes | 2.9 | 5 |
| F | Acetamide | 16 | 3 | yes | 3.7 | 5 |
| G | Ethoxylated amine[3] | 8 | 0 | yes | 2.3 | 5 |
| H | Polytergent CS-1[4] | 12 | 12 | no | 4.8 | 5 |
| I | Nedol 1-9[5] | 19 | 11 | no | 4.3 | 5 |

[1]The statistical test applied was sequential analysis (Amitage, P., Sequential Medial Trials, 2nd Ed., Blackwell, Oxford (1975)
[2]AKZO, Ethomid 0/17
[3]Witco, VARONIC K-205
[4]Olin, polycarboxylated EO condensate of fatty alcohols
[5]Shell, 9EO condensate of $C_{11}$ alcohol As can be seen, Samples D–G were able to significantly reduce the malodor of the thioether-containing surfactant. Each of these materials included a nitrogen group. On the other hand, the two ethoxylated surfactants which do not contain the nitrogen group were unable to significantly reduce the malodor of the thioether surfactant.

EXAMPLE 3

In this Example, an aqueous cleaning formulation within the scope of the present invention was tested for cleaning ability and compared with the cleaning ability of two commercial cleaners and a control which had the equivalent alkalinity of the inventive formulation but did not include the surfactant or other active ingredients. Table 6 sets forth Sample J, the cleaner of the present invention.

The commercial cleaners were Brulin 815 GD®, a phosphate-based cleaner containing a high level of surfactant and Daraclean 235® (W. R. Grace) which contains triethanolamine.

TABLE 6

SAMPLE J

| | wt % |
|---|---|
| Deionized water | 81.910 |
| Sodium bicarbonate | 4.480 |
| Potassium carbonate | 2.900 |

TABLE 6-continued

| SAMPLE J | wt % |
|---|---|
| Sodium carbonate | 2.220 |
| Magnesium oxide | 0.074 |
| BJ 76[1] | 0.250 |
| Sodium nonanoate | 3.000 |
| Alcodet 260 | 3.000 |
| LP 100 | 1.500 |

[1]A polycarboxylated copolymer containing acrylic and maleic acid units and having a molecular weight of about 4,500.

1. A polycarboxylated copolymer containing acrylic and maleic acid units and having a molecular weight of about 4,500.

Sample J of Table 6 and the control examples including the commercial cleaners received as concentrates were diluted (10×) with water and the solutions heated to 160° F.

A soil mix was made of ⅓ part heavy oils and greases taken from the bottoms of a petroleum distillate, ⅓ part used motor oil and ⅓ part axle grease. Approximately 1 gram of the mixed soil was applied to a metal mesh screen. The metal mesh screen was immersed in the heated cleaning solutions and periodically taken from these solutions and weighed to determine the amount of soil removal. The results are shown in the Figure in which each of the data points represents the mean of three measurements.

As can be seen from the Figure, the aqueous cleaner of the present invention yielded substantially improved results after the first minute of cleaning, compared with the alkaline control and the two commercial products.

EXAMPLE 4

In a typical commercial use of the metal cleaning compositions of the present invention, the cleaning solution is continuously filtered to remove solid contaminants or separate a contaminant phase and then recycled for reuse. Upon continual reuse, the cleaning solution will contain an increased amount of contaminants which are contained within the cleaning solution. It is useful that a commercial cleaning composition still be able to clean upon repeated usage of the solution even though the composition contains a significant amount of the contaminants which have been removed from the surface. This example illustrates the useability of the cleaning composition of the present invention.

In this Example, the formulation Sample J which is set forth in Table 6 above was tested to determine its ability to clean after repeated treatments to remove contaminants therefrom.

A soil mix was made of ⅓ part heavy oils and greases taken from the bottoms of a petroleum distillate, ⅓ part used motor oil and ⅓ part axle grease. Approximately 1 gram of the mixed soil was applied to a metal mesh screen.

100 ml of the concentrate (Sample J) set forth in Table 6 was diluted (10×) to 1000 ml with tap water and heated to about 160° F. The metal mesh screen was immersed in the heated cleaning solution for approximately 3 to 4 min. and taken from the solution for weighing to determine the amount of soil removal. The oil remaining on the mesh represents the "initial oil remaining" set forth in Table 7 below.

64 grams of an oil and 135 grams of a greasy bottoms obtained from cleaning metal parts was added to the heated test solution. The amount of contaminants added to the solution represents approximately 4–6 weeks of heavy cleaning. The metal mesh was again immersed in the solution for 3–4 min., removed and weighed to determine the amount of oil still present on the mesh. This represents the "final oil remaining" as set forth in Table 7 below.

The solution was allowed to cool to room temperature and the top oil layer was removed. The solution was then filtered through Celite™. The treated solution was then recorded for weight, pH, and conductance. Makeup solution was then added based on a 1/10 dilution with tap water to 1000 ml and heated to working temperature. The above represents one cleaning cycle. Six of such cleaning cycles were repeated and the results of cleaning are set forth in Table 7 below.

TABLE 7

| cycle # | Initial Oil remaining | Final oil remaining | solution milli-siemens | solution pH |
|---|---|---|---|---|
| 1 | 8% | 60% | 15.4 | 9.2 |
| 2 | 5% | 56% | 24.4 | 9.4 |
| 3 | 9% | 64% | 25.8 | 9.2 |
| 4 | 7% | 71% | 30.6 | 9.4 |
| 5 | 5% | 72% | 34.2 | 9.2 |
| 6 | 8% | 37% | 36 | 9.3 |

The addition of the oil tops and residue bottoms to the cleaning solution for each cycle was meant to simulate approximately 20–30 weeks of cleaning. As can be seen, the solution was able to maintain its cleaning ability throughout the test.

EXAMPLE 5

Sample K represents a particularly useful concentrated formulation in accordance with this invention.

TABLE 8

| SAMPLE K | wt % |
|---|---|
| Deionized water | 79.58 |
| Sodium bicarbonate | 4.480 |
| Potassium carbonate | 2.900 |
| Sodium carbonate | 2.220 |
| Magnesium oxide | 0.074 |
| Carboxylated Polymer[1] | 0.250 |
| Sodium nonanoate | 6.000 |
| Alcodet 260 | 3.000 |
| LP 100 | 1.500 |

[1]Acrylic acid/maleic anhydride copolymer molecular weight of about 4,500.

What is claimed is:

1. An aqueous metal cleaning composition having excellent metal-cleaning properties and reduced thiol-emitted malodor, comprising 20–80 dry weight percent of an alkalinity providing agent and cleaning effective amount of a mixture of surfactants comprising an alkoxylated thiol surfactant and an N-alkyl pyrrolidone surfactant having an alkyl group comprising 6–15 carbon atoms, the N-alkylpyrrolidone surfactant being present in sufficient amounts to reduce malodor of said alkoxylated thiol surfactant, wherein said alkoxylated thiol surfactant is present in said composition in amounts relative to said N-alkylpyrrolidone surfactant of from about 1.0:0.1 to 1.0:2.0 based on he weight of the respective surfactants, further wherein said metal cleaning composition has a pH in water of greater than 8 and less than 12.

2. The metal cleaning composition of claim 1 wherein said alkoxylated thiol surfactant comprises the reaction product of a primary, secondary or tertiary alkyl thiol wherein said alkyl has 6–30 carbon atoms with ethylene oxide, said alkoxylated thiol surfactant comprising 3–20 ethylene oxide groups.

3. The metal cleaning composition of claim 2 wherein said alkoxylated thiol has 7–20 carbon atoms and is ethoxylated with 3–15 ethylene oxide units.

4. The metal cleaning composition of claim 1 wherein the amount of alkoxylated thiol surfactant to said N-alkyl pyrrolidone surfactant is from about 1.0:0.2 to 1.0:1.0 based on the weight of the respective surfactants.

5. The metal cleaning composition of claim 1 wherein said N-alkyl pyrrolidone is an N-(n-alkyl)-2 pyrrolidone.

6. The metal cleaning composition of claim 1 wherein said alkalinity providing agent comprises alkali metal carbonates, alkali metal bicarbonates or mixtures thereof.

7. The metal cleaning composition of claim 6 wherein said alkalinity providing agent comprises a mixture of alkali metal carbonates and alkali metal bicarbonates.

8. The metal cleaning composition of claim 1 further including a polycarboxylate.

9. The metal cleaning composition of claim 1 further including a hydrotrope.

10. The metal cleaning composition of claim 1 comprising 4–50 dry weight percent of said alkoxylated thiol surfactant, 1–30 dry weight percent of said N-alkyl pyrrolidone surfactant, 0–10 dry weight percent of a polycarboxylate and 0–30 dry weight percent of a hydrotrope.

11. The metal cleaning composition of claim 10 wherein said alkalinity providing agent comprises alkali metal carbonate, alkali metal bicarbonate or mixtures thereof and said alkoxylated thiol surfactant comprises an ethoxylated alkyl thiol.

12. An aqueous metal cleaning solution having excellent metal-cleaning properties and reduced thiol-emitted malodor, comprising about 0.1–20 weight percent of a metal cleaning composition an the balance water, said metal cleaning composition comprising 20–80 dry weight percent of an alkalinity providing agent and a cleaning effective amount of a mixture of surfactants comprising an alkoxylated thiol surfactant and an N-alkyl pyrrolidone surfactant having an alkyl group comprising 6–15 carbon atoms, the N-alkylpyrrolidone surfactant being present in sufficient amounts to reduce malodor of said alkoxylated thiol surfactant, wherein said alkoxylated thiol surfactant is present in said composition in amounts relative to said N-alkylpyrrolidone surfactant of from about 1.0:0.1 to 1.0:2.0 based on weight of the respective surfactants, said solution having a pH greater than 8 and less than 12.

13. The metal cleaning solution of claim 12 wherein said metal cleaning composition comprises 4–50 dry weight percent of said alkoxylated thiol surfactant, 1–30 dry weight percent of said N-alkyl pyrrolidone surfactant, 0–10 dry weight percent of a polycarboxylate and 0–30 dry weight percent of a hydrotrope.

14. The metal cleaning solution of claim 13 wherein said alkalinity providing agent comprises alkali metal carbonate, alkali metal bicarbonate or mixtures thereof.

15. The metal cleaning solution of claim 14 wherein said alkoxylated thiol comprises an ethoxylated alkyl thiol having 7–20 carbon atoms and is ethoxylated with 3–15 ethylene oxide units.

16. The metal cleaning solution of claim 12 wherein said N-alkyl pyrrolidone is an N-(n-alkyl)-2 pyrrolidone.

17. The metal cleaning solution of claim 12 wherein said alkalinity providing agent comprises a mixture of alkali metal carbonates and alkali metal bicarbonates.

18. An aqueous metal cleaning concentrate having excellent metal-cleaning properties an reduced thiol-emitted malodor, comprising 5–45 weight percent of a metal cleaning composition and the balance water, said metal cleaning composition comprising 20–80 dry weight percent of an alkalinity providing agent and a cleaning effective amount of mixture of surfactants comprising an alkoxylate thiol surfactant and an N-alkylpyrrolidone surfactant having an alkyl group comprising 6–15 carbon atoms, the N-alkylpyrrolidone surfactant being present in sufficient amounts to reduce malodor of said alkoxylated thiol surfactant, wherein said alkoxylated thiol surfactant is present in said composition in amounts relative to said N-alkylpyrrolidone surfactant of from about 1.0:0.1 to 1.0:2.0 based on weight of the respective surfactants, further wherein said metal cleaning concentrate has a pH of greater than 8 and less than 12.

19. The aqueous cleaning concentrate of claim 18 wherein said metal cleaning composition comprises 4–50 dry weight percent of said alkoxylated thiol surfactant, 1–30 dry weight percent of said N-alkyl pyrrolidone surfactant, 0–10 dry weight percent of a polycarboxylate and 0–30 dry weight percent of a hydrotrope.

20. The aqueous cleaning concentrate of claim 19 wherein said alkalinity providing agent comprises alkali metal carbonate, alkali metal bicarbonate or mixtures thereof.

21. The aqueous cleaning concentrate of claim 20 wherein said alkoxylated thiol comprises an ethoxylated alkyl thiol having 7–20 carbon atoms and is ethoxylated with 3–15 ethylene oxide units.

22. The metal cleaning solution of claim 18 wherein said N-alkyl pyrrolidone is an N-(n-alkyl)-2 pyrrolidone.

23. The aqueous cleaning concentrate of claim 18 wherein said alkalinity providing agent comprises a mixture of alkali metal carbonates and alkali metal bicarbonates.

24. A method of cleaning a metal substrate so as to remove contaminants therefrom comprising contacting said metal substrate with an aqueous cleaning solution comprising the metal cleaning composition of claim 1 in water, wherein said metal substrate is contacted with said aqueous cleaning solution for a sufficient time to remove said contaminants from said substrate.

25. The method of cleaning metal substrates of claim 24 wherein said metal cleaning composition comprises 4–50 dry weigh percent of said alkoxylated thiol surfactant, 1–30 weight percent of said N-alkyl pyrrolidone surfactant, 0–10 weight percent of a polycarboxylate and 0–30 dry weight percent of a hydrotrope.

26. The method of cleaning metal substrates of claim 25 wherein said alkalinity providing agent comprises alkali metal carbonate, alkali metal bicarbonate or mixtures thereof.

27. The method of cleaning metal substrates of claim 26 wherein said alkoxylated thiol comprises an ethoxylated alkyl' thiol having 7–20 carbon atoms and is ethoxylated with 3–15 ethylene oxide units.

28. The method of cleaning metal substrates of claim 24 wherein said alkalinity providing agent comprises a mixture of alkali metal carbonates and alkali metal bicarbonates.

29. The method of claim 24 wherein said aqueous cleaning solution contains 0.1–20 weight percent of said metal cleaning composition and has a pH of greater than 8 and less than 12.

30. The method of claim 29 wherein said aqueous cleaning solution has a pH from about 8 to about 10.

31. The method of claim 24 wherein said metal substrates comprise metal parts and wherein said metal parts are contacted with said aqueous cleaning solution in a metal parts washer by immersion, impingement or both, said metal parts separated from said cleaning solution and said aqueous cleaning solution is reused in said parts washer to clean additional parts.

32. The method of claim 31 wherein said metal parts are sprayed with said aqueous cleaning solution.

33. The method of claim 32 wherein said aqueous cleaning solution is at a temperature of from about 90° –180° F. and said metal parts are contacted with said aqueous cleaning solution for about 1–30 minutes.

34. A surfactant composition comprising an alkoxylated thiol surfactant which has a malodor and an N-alkyl pyrrolidone surfactant in amounts sufficient to reduce the malodor of said alkoxylated thiol surfactant, wherein said alkoxylated thiol surfactant is present in said composition in amounts relative to said N-alkyl pyrrolidone surfactant of from about 1.0:0.1 to 1.0:2.0 based on the weight of the respective surfactants, further wherein said N-alkyl pyrrolidone surfactant has an alkyl group comprising 6–15 carbon atoms.

35. The surfactant composition of claim 34 wherein said alkoxylated thiol surfactant comprises the reaction product of a primary, secondary or tertiary alkyl thiol wherein said alkyl has 6–30 carbon atoms with ethylene oxide, said alkoxylated thiol surfactant comprising 3–20 ethylene oxide groups.

36. The surfactant composition of claim 35 wherein said alkoxylated thiol has 7–20 carbon atoms and is ethoxylated with 3–15 ethylene oxide units.

37. The surfactant composition of claim 34 wherein the amount of alkoxylated thiol surfactant to said N-alkyl pyrrolidone surfactant is from about 1.0:0.2 to 1.0:1.0 based on the weight of the respective surfactants.

38. The surfactant composition of claim 34 wherein said N-alkyl pyrrolidone is an N-(n-alkyl)-2 pyrrolidone.

39. The metal cleaning composition of claim 1, wherein said metal cleaning composition is free of organic solvents.

40. The metal cleaning solution of claim 12, wherein said metal cleaning solution is free of organic solvents.

41. The aqueous cleaning concentrate of claim 18, wherein said aqueous cleaning concentrate is free of organic solvents.

* * * * *